US006821221B2

(12) United States Patent
Derus et al.

(10) Patent No.: US 6,821,221 B2
(45) Date of Patent: Nov. 23, 2004

(54) ARROW POINT WITH SELF LUBRICATING COLLAR

(75) Inventors: Michael Derus, Port Richey, FL (US); Louis Daniel Massimillo, Gainesville, FL (US)

(73) Assignee: SOP Services, Inc., Las Vegas, NV (US)

( * ) Notice: Subject to any disclaimer, the term of this patent is extended or adjusted under 35 U.S.C. 154(b) by 0 days.

(21) Appl. No.: 10/278,175

(22) Filed: Oct. 22, 2002

(65) Prior Publication Data

US 2004/0077441 A1 Apr. 22, 2004

(51) Int. Cl.[7] ..... A63B 65/02
(52) U.S. Cl. ..... 473/582; 124/4
(58) Field of Search ..... 124/4–6; 473/578, 473/582, 585, 586

(56) References Cited

U.S. PATENT DOCUMENTS 2,613,936 A * 10/1952 Dalton ..... 473/582
3,868,114 A * 2/1975 Groner ..... 473/582
4,944,520 A * 7/1990 Fingerson et al. ..... 473/582
4,988,112 A * 1/1991 Anderson et al. ..... 473/585
5,114,156 A 5/1992 Saunders
5,269,534 A * 12/1993 Saunders et al. ..... 473/582
5,295,692 A * 3/1994 Wright ..... 473/578
5,749,440 A 5/1998 Coffey et al.
5,902,199 A 5/1999 Adams, Jr.
6,093,685 A 7/2000 Wood

OTHER PUBLICATIONS

Advertisement, "Z Point" target tip sold by Bohning Archery
advertisement, "Easy Pull Points" sold by Precision Design Products.

* cited by examiner

*Primary Examiner*—K. T. Nguyen
(74) *Attorney, Agent, or Firm*—Woodard, Emhardt, Moriarty, McNett & Henry LLP

(57) ABSTRACT

An arrow point having a self lubricating collar.

29 Claims, 1 Drawing Sheet

ARROW POINT WITH SELF LUBRICATING COLLAR

CROSS-REFERENCE TO RELATED APPLICATIONS

There are no related applications.

STATEMENT AS TO RIGHTS TO INVENTION MADE UNDER FEDERALLY SPONSORED RESEARCH AND DEVELOPMENT

The invention disclosed and claimed herein was not made under any federally sponsored research and development program.

A. BACKGROUND OF THE INVENTION

1. Field of the Invention

This invention relates to an arrow point for attachment to an arrow used in target practise.

2. Description of the Prior Art

Although the present invention is not limited to arrows used in high energy compound bows, it is noted that such high energy compound bows may fire arrows at speeds in excess of 300 feet per second. While targets made of dense foam or banded layers of foam have been found effective to halt the flight of such arrows, it has been found that retracting the arrow from such targets is difficult and also that the targets leave a residue on the arrow that needs to be removed before the arrow is used again.

There have been various approaches to facilitating arrow removal from targets. For example, lubricants have been applied to the arrow points and shafts to facilitate removal. Certain such lubricants are disclosed in U.S. Pat. No. 5,749,440 and U.S. Pat. No. 6,093,685. Another approach to facilitate arrow removal is embodied in an arrow point sold by Precision Design Products. This design includes an arrow point which is oversized and chamfered on the backside to enhance arrow removal from targets. A further approach is an arrow point sold by Bohning Archery under the "Z Point" trademark. This arrow point includes a tapered design to ease arrow shaft removal from foam targets and also includes an O-ring collar located behind a shoulder of the tip portion for maintaining the arrow point tight within the arrow shaft while the bow is being fired.

While not concerned with facilitating arrow removal from a target, U.S. Pat. No. 5,902,199 shows a composite arrow point comprising a weight collar located behind a shoulder of a point body containing the tip portion. The purpose of the weight collar is to produce a tuning arrow having the same weight and balance point as the arrows to be shot from the bow during normal shooting. U.S. Pat. No. 5,114,156, while again not being concerned with facilitating arrow removal, includes an arrow point of a contoured exterior configuration to allow the arrow to enter the target in a smooth and unobtrusive manner.

B. SUMMARY OF THE INVENTION

According to the present invention, an arrow includes a point having a self lubricating collar for facilitating removal of the arrow from a target. The arrow point is screwed into the arrow shaft or glued in the arrow shaft.

In a first embodiment of the arrow point, the arrow point includes a steel tip having a head portion, an intermediate portion and a threaded portion. The threaded portion is screwed into a threaded bore in an insert in the arrow shaft. The outer diameter of the head portion tapers rearwardly to its largest diameter at a shoulder of the head portion. A self lubricating collar extends around the intermediate portion of the tip and is compressed in place on the tip when the threaded portion of the tip is screwed into the threaded bore of the insert in the arrow shaft. The outer diameter of the self lubricating collar is greatest at its junction with the underside of the head portion shoulder and decreases as it extends rearwardly until it is the same as the outer diameter of the arrow shaft.

In a second embodiment of the arrow point, the previously described tip includes a stud instead of the intermediate portion and threaded portion, and the stud is glued into an insert in the arrow shaft. In all other respects, the first and second embodiments are the same.

It has been found that the arrow points of the present invention reduce the friction between the arrow and the target when the arrow is removed from the target thus facilitating the removal of the arrow from the target. In addition, because the lubricating collar of the present invention replaces the annular section behind the head portion of certain prior art arrow points, and because the lubricating collar is formed of plastic whereas the annular section of such prior art arrow points was typically formed of steel, the arrow point of the present invention will be lighter than those prior art arrow points. Furthermore, the lubricating collar of the first embodiment of the present invention is compressed into the insert and functions as a lock washer to secure the arrow point to the arrow shaft, when the arrow point is screwed into the insert.

Other objects and attendant advantages of this invention will be readily appreciated as the same becomes more clearly understood by references to the following detailed description when considered in connection with the accompanying drawings in which like reference numerals designate like parts throughout the figures thereof.

C. BRIEF DESCRIPTION OF THE DRAWINGS

D. DETAILED DESCRIPTION OF THE PREFERRED EMBODIMENTS

Figure 1:
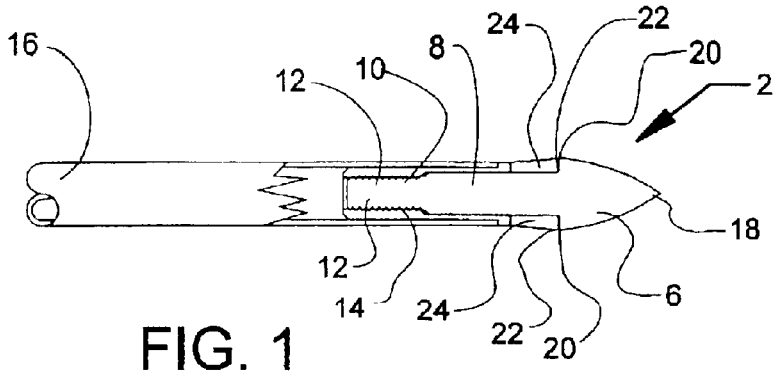
FIG. 1 is a sectional side elevational view of a first embodiment of the present invention.

For a fuller understanding of the nature and objects of the invention, reference should be had to the following detailed description taken in connection with the accompanying drawing forming a part of this specification and in which similar numerals of reference indicate corresponding parts in all the figures of the drawing.

The first embodiment of the invention is shown in FIG. 1 and includes arrow point 2 preferably formed of steel. The arrow point 2 includes a head portion 6, an intermediate portion 8 and a threaded portion 10. The threaded portion 10 of arrow point 2 is screwed into a threaded bore 12 in insert 14 of arrow shaft 16. The arrow shaft 16, shown partially in FIG. 1, is preferably formed of carbon but may be formed of other materials as are known in the art. The insert 14, which may be formed of aluminum or plastic is secured to the interior of arrow shaft 16 by adhesive. When the threaded portion 10 of arrow point 2 is screwed into threaded bore 12 of insert 14 by twisting head portion 6, the self lubricating collar 24, described below, is compressed against the insert 14 and functions as a lock washer to secure the arrow point 2 to the arrow shaft 16.

The head portion 6 of arrow point 2 includes an outer diameter that increases from the front 18 of arrow point 2 to the shoulder 20 of head portion 6 so that the outer diameter is largest at 22. It is seen in FIG. 1 that the outer diameter of arrow point 2 at 22 is greater than the outer diameter of arrow shaft 16.

Figure 4:
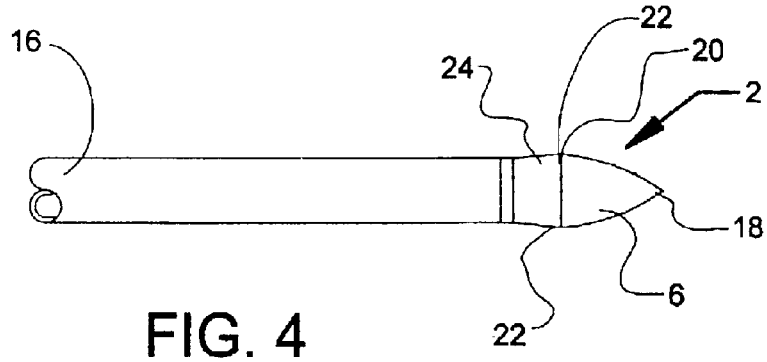
FIG. 4 is a side elevational view of the first embodiment of the present invention.

The self lubricating collar 24 extends around the intermediate portion 8 of arrow point 2 and is compressed in place against shoulder 20 of arrow point 2 when the threaded portion 10 of arrow point 2 is screwed into the threaded bore 12 of insert 14 of arrow shaft 16. The self lubricating collar 24 may be formed of acetal plastic such as sold by E. I. du Pont de Nemours and Company under the trademark "Delrin", although other self lubricating materials may also be used. The outer diameter of the self lubricating collar 24 is largest at point 22 and tapers rearwardly and downwardly until it is the same diameter as arrow shaft 16. The side elevational view of the first embodiment of the present invention shown in FIG. 4 is the same as the side elevational view of the second and third embodiments of the present invention, described below.

Figure 2:
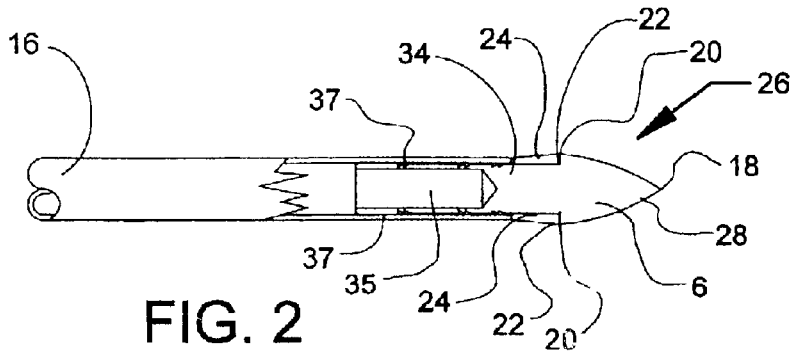
FIG. 2 is a sectional side elevational view of a second embodiment of the present invention.

A second embodiment of the invention is shown on FIG. 2 and includes arrow point 26 having a head portion 28 and a cylindrical portion 34. Self lubricating collar 24 extends around the cylindrical portion 34 and is sandwiched between shoulder 20 of arrow point 26 and arrow shaft 16. An opening 35 is drilled in cylindrical portion 34 to reduce the weight of cylindrical portion 34. The cylindrical portion 34 of arrow point 26 is affixed to the interior surface 37 of arrow shaft 16 by adhesive and in that manner the arrow point 26 is connected to the arrow shaft 16. Other elements of the second embodiment shown in FIG. 2 which are common with elements of the first embodiment shown in FIG. 1 are identified by the same reference numbers as are used in FIG. 1.

Figure 3:
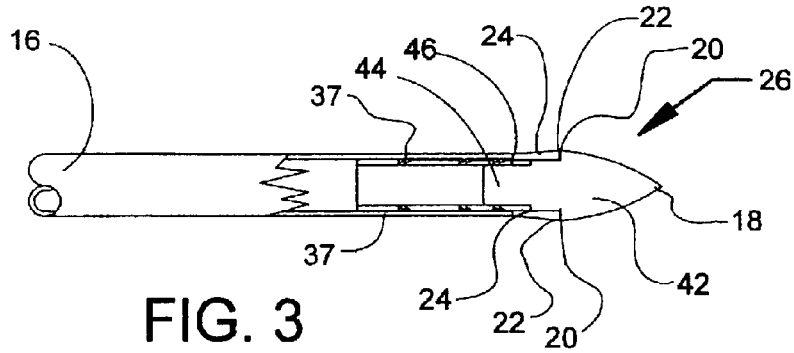
FIG. 3 is a sectional side elevational view of a third embodiment of the present invention.

A third embodiment of the invention is shown in FIG. 3 and includes arrow point 40 having a head portion 42 and a rear portion 44. A discrete hollow cylinder 46 surrounds rear portion 44 of arrow point 40 and is attached to rear portion 44 by, for example, crimping. Self lubricating collar 24 which extends partially around the rear portion 44 of arrow point 40 and partially around hollow cylinder 46 is sandwiched between shoulder 20 of arrow point 40 and arrow shaft 16. The hollow cylinder 46 of arrow point 40 is affixed to the interior surface 37 of arrow shaft 16 by adhesive and in that manner the arrow point 40 is connected to the arrow shaft 16. Here, again, other elements of the third embodiment shown in FIG. 3 which are common with elements of the first embodiment shown in FIG. 1 are identified by the same reference numbers as are used in FIG. 1.

When the arrow points 2, 26 or 40 of the present invention are removed from a target, the lubrication in self lubricating collar 24 reduces the friction between the arrow and the target and facilitates removal of the arow from the target. Furthermore, because lubricating collar 24 is formed of lighter weight plastic, it reduces the weight of a steel arrow of comparable configuration. In addition, with respect to the embodiment of the present invention shown in FIG. 1, the lubricating collar 24 is compressed into insert 14 in arrow shaft 16 when the arrow point 2 is screwed into insert 14, and functions as a lock washer to secure the arrow point 2 to the arrow shaft 16. Because the arrow points 2, 26 and 40 have larger outer diameters than the outer diameter of the arrow shaft 16, the hole in the target created by the arrow is larger than the diameter of the arow shaft and there is less friction on the arrow shaft when it is removed from the target.

This invention has been described above with reference to presently preferred embodiments of the invention; such description has not been presented as a catalog exhaustive of all forms which this invention may take. Accordingly, workers skilled in the art to which this invention pertains will readily appreciate that variations, alterations or modifications in the structures, procedures, and arrangements described above may be practiced without departing from the scope of this invention.

What is claimed as novel and desired to be secured by Letters Patent is:

1. An arrow point for use with an arrow having an arrow shaft, and a self lubricating collar formed of acetal plastic on said arrow point for facilitating removal of the arrow from a target, wherein said self lubricating collar extends around said arrow point, wherein said arrow point includes a head portion having a shoulder thereon and wherein said self lubricating collar is located adjacent said shoulder, wherein the arrow point includes an intermediate portion and wherein said self lubricating collar extends around the intermediate portion, and wherein the outer diameter of the arrow point is greater than the outer diameter of the arrow shaft.

2. An arrow point as recited in claim 1 wherein the largest outer diameter of the self lubricating collar is greater than the outer diameter of the arrow shaft.

3. An arrow point as recited in claim 1 wherein the arrow point includes a threaded portion for securing the arrow point to an insert in the arrow shaft.

4. An arrow point as recited in claim 1 wherein the arrow point includes a cylindrical portion adapted to be affixed to the interior of the arrow shaft.

5. An arrow point for use with an arrow having an arrow shaft, and a self lubricating collar on said arrow point for facilitating removal of the arrow from a target, wherein said self lubricating collar extends around said arrow point, wherein the largest outer diameter of the self-lubricating collar is greater than the outer diameter of the arrow shaft, wherein said arrow point includes a head portion having a shoulder thereon and wherein said self lubricating collar is located adjacent said shoulder, wherein the arrow point includes an intermediate portion and wherein said self lubricating collar extends around the intermediate portion, and wherein the arrow point includes a threaded portion for securing the arrow point to the arrow shaft.

6. An arrow point as recited in claim 5 wherein the self lubricating collar is formed of acetal plastic.

7. An arrow point for use with an arrow having an arrow shaft, and a self lubricating collar on said arrow point for facilitating removal of the arrow from a target, wherein said self lubricating collar extends around said arrow point, wherein said arrow point includes a head portion having a shoulder thereon and wherein said self lubricating collar is located adjacent said shoulder, wherein the arrow point includes an intermediate portion and wherein said self lubricating collar extends around the intermediate portion, wherein the arrow point includes a threaded portion for securing the arrow point to an insert in the arrow shaft, and wherein the self lubricating collar is adapted to be compressed against the insert to secure the arrow point to the arrow shaft when the threaded portion of the arrow point is secured to said insert.

8. An arrow point as recited in claim 7 wherein the self lubricating collar is formed of acetal plastic.

9. An arrow point for use with an arrow having an arrow shaft, and a self lubricating collar formed of acetal plastic on said arrow point for facilitating removal of the arrow from a target, wherein said self lubricating collar extends around said arrow point, wherein said arrow point includes a head portion having a shoulder thereon and wherein said self lubricating collar is located adjacent said shoulder, wherein the arrow point includes a cylindrical portion adapted to be affixed to the interior of the arrow shaft, and wherein said self lubricating collar is adapted to extend around the cylindrical portion.

10. An arrow point as recited in claim 9 wherein the self lubricating collar is formed of acetal plastic.

11. An arrow point as recited in claim 9 wherein the arrow point includes a threaded portion for securing the arrow point to the arrow shaft.

12. An arrow point for use with an arrow having an arrow shaft, and a self lubricating collar on said arrow point for facilitating removal of the arrow from a target, wherein said self lubricating collar extends around said arrow point, wherein said arrow point includes a head portion having a shoulder thereon and wherein said self lubricating collar is located adjacent said shoulder, and including a hollow cylinder adapted to be attached to the arrow point and wherein said hollow cylinder is adapted to be affixed to the interior of the shaft.

13. An arrow point as recited in claim 12 wherein said self lubricating collar is adapted to extend partially around said arrow point and partially around said hollow cylinder.

14. An arrow point as recited in claim 12 wherein the self lubricating collar is formed of acetal plastic.

15. An arrow point as recited in claim 12 wherein the arrow point includes a threaded portion for securing the arrow point to the arrow shaft.

16. An arrow comprising: an arrow shaft, an arrow point and a self lubricating collar formed of acetal plastic on said arrow point for facilitating removal of the arrow from a target, wherein said self lubricating collar extends around the arrow point, wherein said arrow point includes a head portion having a shoulder thereon and wherein said self lubricating collar is located adjacent said shoulder, wherein the arrow point includes an intermediate portion and wherein said self lubricating collar extends around the intermediate portion, and wherein the outer diameter of the arrow point is greater than the outer diameter of the arrow shaft.

17. An arrow as recited in claim 16 wherein the largest outer diameter of the self lubricating collar is greater than the outer diameter of the arrow shaft.

18. An arrow as recited in claim 16 wherein the arrow point includes a threaded portion for securing the arrow point to an insert in the arrow shaft.

19. An arrow as recited in claim 16 wherein the arrow point includes a cylindrical portion adapted to be affixed to the interior of the arrow shaft.

20. An arrow as recited in claim 16 wherein the arrow point includes a threaded portion for securing the arrow point to the arrow shaft.

21. An arrow comprising: an arrow shaft, an arrow point and a self lubricating collar on said arrow point for facilitating removal of the arrow from a target, wherein said self lubricating collar extends around the arrow point, wherein said arrow point includes a head portion having a shoulder thereon and wherein said self lubricating collar is located adjacent said shoulder, wherein the arrow point includes an intermediate portion and wherein said self lubricating collar extends around the intermediate portion, wherein the arrow point includes a threaded portion for securing the arrow point to an insert in the arrow shaft, and wherein the self lubricating collar is adapted to be compressed against the insert to secure the arrow point to the arrow shaft when the threaded portion of the arrow point is secured to said insert.

22. An arrow as recited in claim 21 wherein the self lubricating collar is formed of acetal plastic.

23. An arrow comprising: an arrow shaft, an arrow point and a self lubricating collar on said arrow point for facilitating removal of the arrow from a target, wherein said self lubricating collar extends around the arrow point, wherein said arrow point includes a head portion having a shoulder thereon and wherein said self lubricating collar is located adjacent said shoulder, wherein the arrow point includes a cylindrical portion that is adapted to be affixed to the interior of the arrow shaft, and wherein said self lubricating collar is adapted to extend around the cylindrical portion.

24. An arrow as recited in claim 23 wherein the self lubricating collar is formed of acetal plastic.

25. An arrow as recited in claim 23 wherein the arrow point includes a threaded portion for securing the arrow point to the arrow shaft.

26. An arrow comprising: an arrow shaft, an arrow point and a self lubricating collar on said arrow point for facilitating removal of the arrow from a target, wherein said self lubricating collar extends around the arrow point, wherein said arrow point includes a head portion having a shoulder thereon and wherein said self lubricating collar is located adjacent said shoulder, and including a hollow cylinder which is attached to the arrow point and wherein said hollow cylinder is adapted to be affixed to the interior of the shaft.

27. An arrow as recited in claim 26 wherein said self lubricating collar is adapted to extend partially around said arrow point and partially around said hollow cylinder.

28. An arrow as recited in claim 26 wherein the self lubricating collar is formed of acetal plastic.

29. An arrow as recited in claim 26 wherein the arrow point includes a threaded portion for securing the arrow point to the arrow shaft.

* * * * *